United States Patent [19]

Blaak

[11] 4,363,833

[45] Dec. 14, 1982

[54] METHOD AND APPARATUS FOR COATING A POROUS SUBSTRATUM

[75] Inventor: Cornelis Blaak, Boxmeer, Netherlands

[73] Assignee: Stork Brabant B.V., Netherlands

[21] Appl. No.: 247,140

[22] Filed: Mar. 24, 1981

[30] Foreign Application Priority Data

Mar. 27, 1980 [NL] Netherlands ..... 8001814

[51] Int. Cl.[3] ..... B05D 3/12; B41L 13/00; B05C 11/02

[52] U.S. Cl. ..... 427/211; 101/119; 101/120; 118/123; 118/124; 118/406; 427/358; 427/359; 427/365; 427/428; 427/356

[58] Field of Search ..... 427/356, 358, 365, 366, 427/359, 428, 211; 118/406, 123, 124; 101/119, 120

[56] References Cited

U.S. PATENT DOCUMENTS

| | | | |
|---|---|---|---|
| 1,924,994 | 8/1933 | Knapp . | |
| 3,152,918 | 10/1964 | Kraus | 427/358 |
| 3,186,681 | 6/1965 | Lowrey . | |
| 3,863,597 | 2/1975 | Anselrode . | |
| 3,919,973 | 11/1975 | Zimmer | 101/120 X |
| 4,061,109 | 12/1977 | Allen . | |
| 4,103,615 | 8/1978 | Craz et al. | 101/120 |

FOREIGN PATENT DOCUMENTS

| | | | |
|---|---|---|---|
| 2040567 | 2/1971 | Fed. Rep. of Germany | 101/119 |
| 2303607 | 10/1976 | France . | |
| 1342504 | 1/1974 | United Kingdom . | |

*Primary Examiner*—Michael R. Lusignan
*Attorney, Agent, or Firm*—Ostrolenk, Faber, Gerb & Soffen

[57] ABSTRACT

Coating a porous substratum with a viscous substance is performed by means of a rotatable cylindrical sieve (plain-mesh screen), comprising an internal squeegee for pressing said substance through the perforations of the screen. The substratum are passed in contact with the screen and is supported at the contact zone by a roller. Although the peripheral speeds of the screen and the substratum is substantially equal, the rotational speed of the support roller is such, that its peripheral speed is either smaller or greater than that of the substratum to an extent of at least 5%. This avoids the occurrence of the phenomenon of pinhole formation in the coated substratum.

29 Claims, 5 Drawing Figures

$V_w = V_s$

METHOD AND APPARATUS FOR COATING A POROUS SUBSTRATUM

BACKGROUND OF THE INVENTION

1. Field of the Invention

The present invention relates to a method of coating a permeable web, such as a textile, a fibrous fleece or a similar substratum having an open structure with a viscous substance, while using at least one combination consisting of a rotatable cylindrical screen with a support roller, between which the substratum to be coated is passed, the interior of said screen being provided with means such as a squeegee, for pressing the substance through the perforations of the screen.

The object of such a method is to obtain a textile material which, in view of the properties desired or the improvement thereof, is provided on one or both sides with a single or several layers of coating. The textile substratum ensures the flexibility required for the final product and often serves for absorbing the mechanical stress exerted thereon. The substratum may consist of a woven fabric, a knitted material, a fibrous fleece etc., the weight and permeability of the substratum being allowed to vary within wide limits.

2. Description of the Prior Art

In the prior art methods have been used which are known in practice as "knife-coating, reverse-roll coating" (see Netherlands Patent Application No. 70,06063), while a process called dip coating is referred to as well.

These known methods cannot be controlled sufficiently for obtaining a reliable and reproducible process realizing a constant quality of the final product, as in such a case it is an important drawback that the amount of substance applied cannot be controlled independently with regard to the degree of penetration into the substratum. Attempts have been made to solve the latter problems in a system according to Netherlands Patent Application No. 71,01419.

SUMMARY OF THE INVENTION

With a view to the aforementioned state of the art it is a primary object of the present invention to provide a method whereby a textile substratum is provided with a one-side coating by means of the known rotary screen printing technique. An adapted choice of the screen and of the adjustment of the internal squeegee thus affords an accurate determination of the quantity of substance being applied upon the substratum per unit surface. According to the invention the (or each) support roller is driven at a peripheral speed differing by at least 5% from the linear speed of the substratum as determined by the screen.

In rotary screen printing techniques it is necessary to drive the support roller or impression cylinder supporting the substratum at the location of the screen, at a speed equal to that of the substratum. In most instances the support roller is freely rotatable and automatically acquires the same peripheral speed as the substratum. It has emerged in practice, however, that in the case of an open substratum structure for which it is desirable to obtain an even coating, a difference in speed between support roller and substratum leads to the result intended. Thus the phenomenon of pinholes occurring at an equal speed of the substratum and support roller is effectively prevented.

The method outlined above is preferably so carried out that the substratum remains in contact with the support roller in an arc following the area within which the substance is being applied. Due to this arched contact, the clearance between the substratum and the screen cylinder on the exit side is increased, so that the paste to be applied can flow out with less resistance.

An even layer of coating on both sides of the substratum is more properly obtained when—as seen in the direction of travel—past the combination of screen cylinder/support roller, a doctor blade is provided resting on the substratum on the side of the substance applied and a second doctor blade co-operating with the substratum on the opposite side thereof.

The present invention is also embodied in an apparatus for carrying out the method as described hereinbefore, said apparatus comprising a screen cylinder provided with an internal squeegee construction, and a support roller enabling a substratum to be guided along and to be in contact with the screen cylinder.

According to the invention, said apparatus also comprises means for driving the substratum at substantially the same speed as the peripheral speed of the screen cylinder the speed of the drive of the support roller differing therefrom by at least 5%.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF A PREFERRED EMBODIMENT

Figure 1:
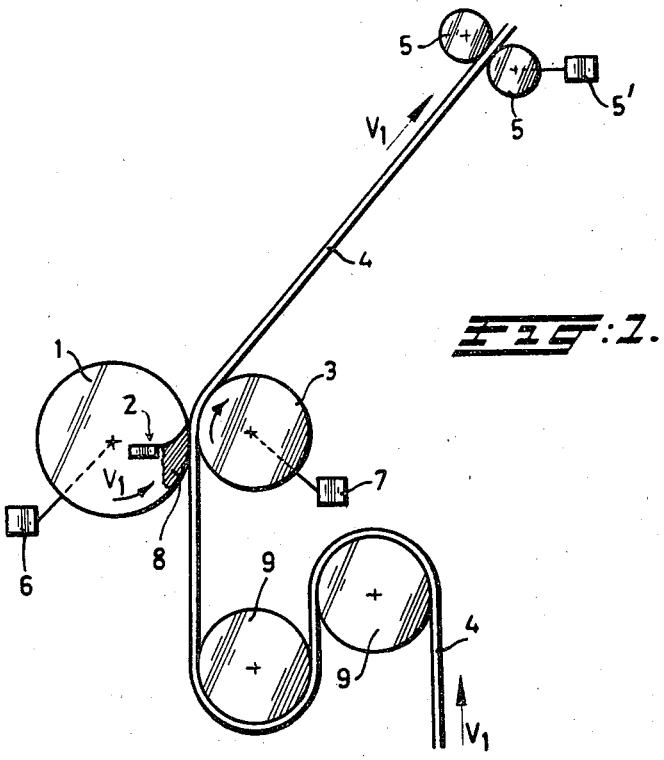
FIG. 1 is a side view of the essential elements of the apparatus, according to the invention.

Referring to FIG. 1 the apparatus comprises a screen cylinder 1 provided with an internal squeegee construction 2. Opposite said cylinder 1 a support roller 3 enables a substratum 4 having an open structure, such as a fibrous fleece, to be led along the cylinder 1 and to be in contact therewith. The apparatus further comprises drive means 5, 6 and 7, as very schematically indicated. Means 5 consist of, for instance, a pair of rollers and a drive motor 5' by means of which the substratum 4 is imparted a traveling speed $V_s = V_1$. Means 6 is coupled to screen cylinder 1 and ensure a peripheral speed of said cylinder equal to $V_1$. As a result, screen cylinder 1 functioning as a stencil, co-operates in the usual manner with substratum 4 passing by, and a substance indicated at 8 is applied upon the substratum by means of squeegee construction 2. So far the apparatus is fairly conventional.

Figure 2:
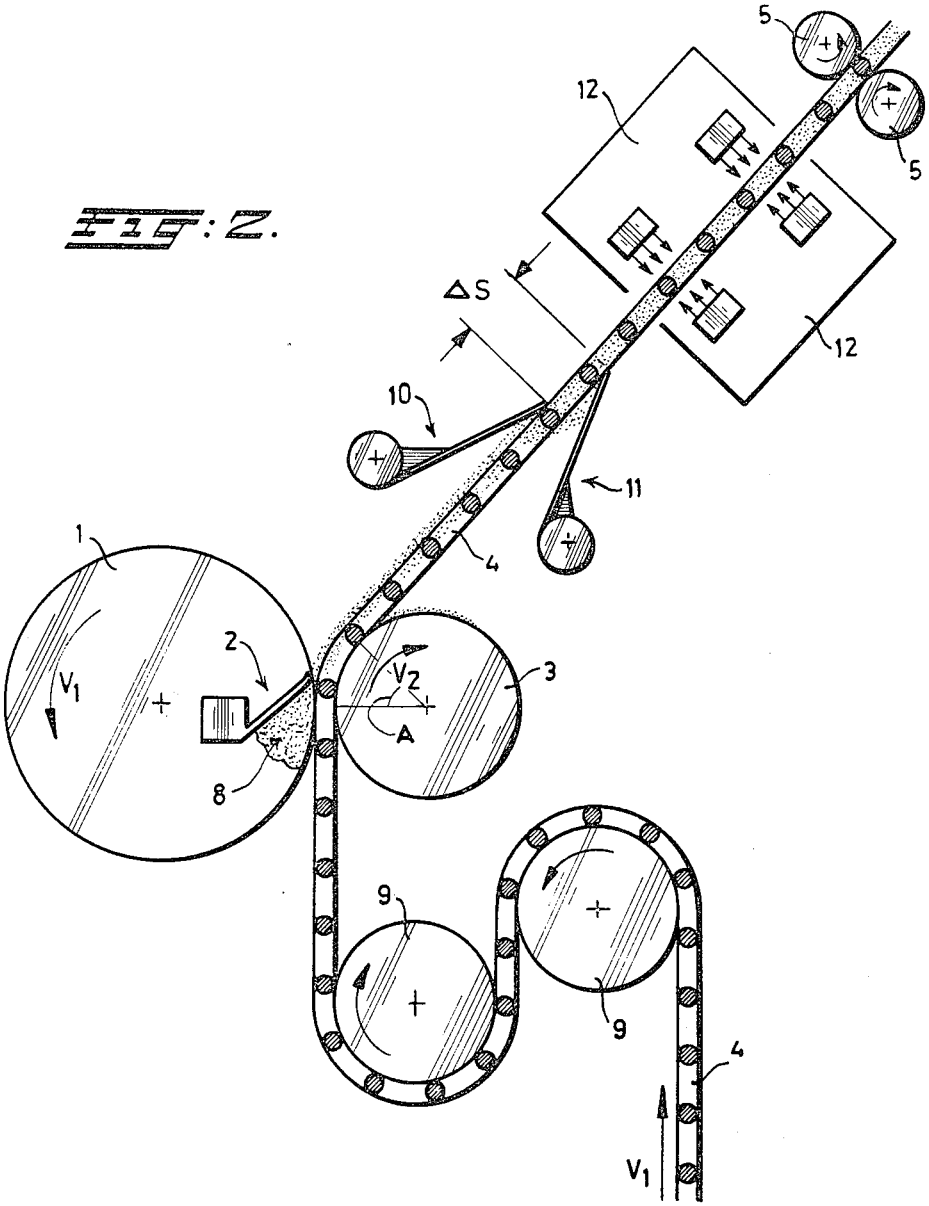
FIG. 2 is an enlarged view of the most important portion of the apparatus of FIG. 1.

Drive means 7 is coupled to support roller 3 and impart to said support roller a peripheral speed $V_w = V_2$ which differs from speed $V_1$ by at least 5%. This difference in speed may be either positive or negative, but is elucidated hereinafter with reference to a situation wherein $V_2$ is greater than $V_1$. As is apparent from FIGS. 1 and 2, in the path of entry of substratum 4 there are two more guide rollers 9 provided. Referring now to FIG. 2, there are located in the path of exit of substratum 4 coated with substance 8, a doctor blade 10 and a doctor blade 11, on the coated side and on the opposite side of the substratum, respectively. The function of said doctor blades will still be further explained with reference to FIG. 5. Past the doctor blades 10 and 11, the coated substratum 4 passes through a gelling (curing) oven 12.

Figure 3:
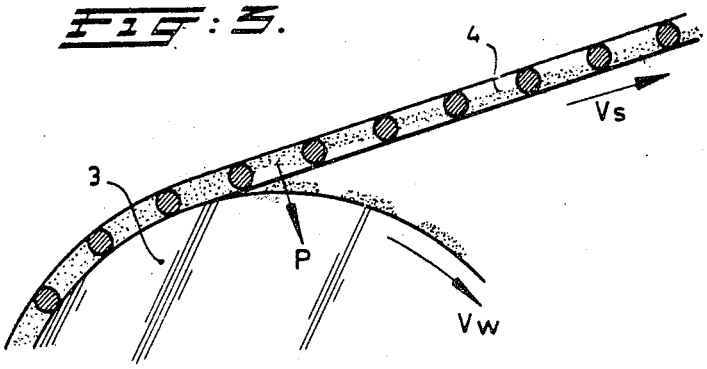
FIGS. 3 and 4 show the effect of the speed difference which plays a part in the method according to the present invention.

Substratum 4 remains in contact with support roller 3 in an arched area A of approximately 45° following the area within which substance 8 is applied onto the substratum. As a result of the open structure of the substratum, substance 8 penetrates through the fibres and reaches the uncoated side of the substratum. If in such instance—as in the case in the conventional method—support roller 3 should have the same speed as substratum 4, the phenomenon known as "pinhole formation", would occur. The adhesion of substance 8 to the peripheral surface of support roller 3 produces a force P directed transversely toward the substratum, as a result of which the substance between the fibers is pulled out of substratum 4 (FIG. 3).

Figure 4:
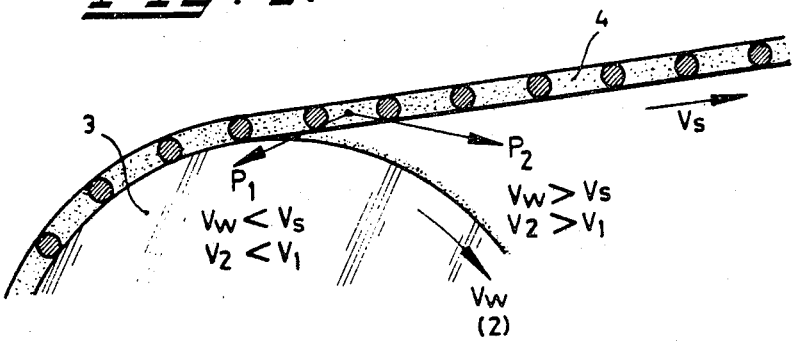

This troublesome phenomenon is avoided in the method according to the invention in that the peripheral speed of support roller 3 is made to differ from the speed of travel of substratum 4. Referring now to FIG. 4, this situation is illustrated showing both a positive and a negative difference. If $V_2$ is smaller than $V_1$ there arises a force $P_1$ which has a considerable component opposed to the direction of travel of substratum 4 and a small component perpendicular thereto. This causes only a very little amount of substance to be transferred onto support roller 3 and a state of equilibrium to settle down rapidly, the outer periphery of support roller 3 being provided with a thin layer of substance 8. The same situation arises when $V_2$ is greater than $V_1$. (see force $P_2$).

Figure 5:
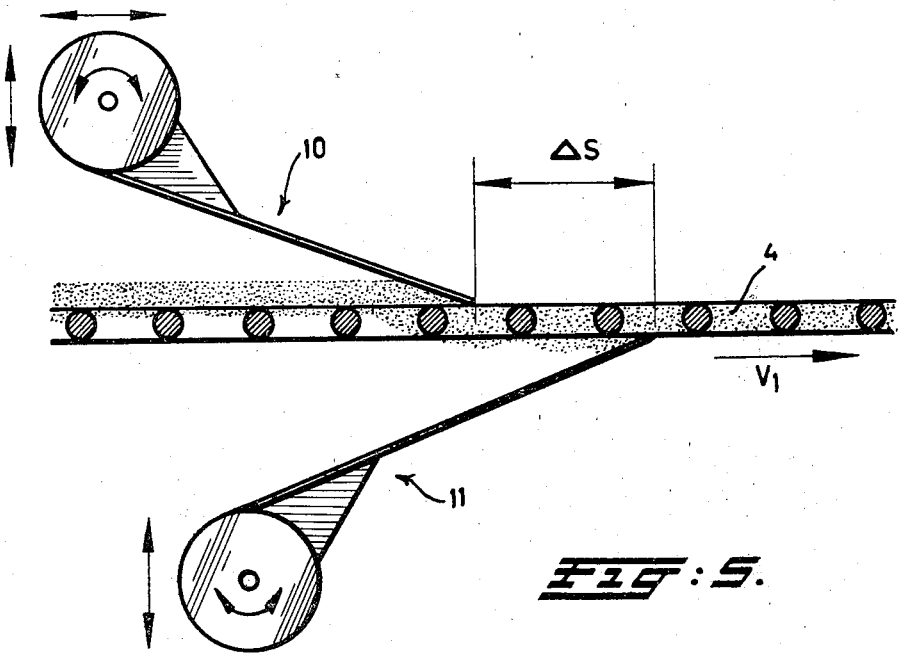
FIG. 5 is a detail of FIG. 2 on a still further enlarged scale.

Referring now to FIG. 5, following the penetration of substance 8 into substratum 4 (FIG. 4), doctor blade 10 enters into action on the coated side of the substratum. This doctor blade ensures that substance 8 is equalized and is pressed, to a sufficient degree, through the openings in the substratum toward the uncoated side. Thus, a certain amount of substance 8 will also get to that side and subsequently be equalized by doctor blade 11. The combination of these two doctor blades may be considered as a flexible nip. The arrows indicate the possibilities of adjustment of the blades 10 and 11, so that dependent on the structure and properties of substratum 4, the viscosity of substance 8, etc., it is possible to attain an optimum adjustment. Thereupon the substratum, without any prior contact, is led through the gelling (curing) oven 12. It is only thereafter that the coated web may travel over the guide rollers to its place of destination.

So far the present invention has been discussed with reference to an apparatus provided with one single combination consisting of a rotatable cylindrical screen 1 and a support roller 3. However, the invention is also applicable in serial substratum-treatment processes, wherein two or several layers are applied consecutively "wet on wet", prior to introducing the coated substratum into the gelling (curing) oven 12.

EXAMPLE substratum 4=fabric 1000 denier 9/9, 210 g/m$^2$
$V_1$=10 m/min.
$V_2$=0 to 5 m/min.
screen cylinder 1=11 mesh (openings per linear inch) screen opening diameter 1.6 mm wall thickness 400μ
substance 8 has the following composition:

| | |
|---|---|
| PVC | 150 parts by weight |
| plasticizer | 50 parts by weight |
| stabilizer | 4 parts by weight |
| filling agent | 3 parts by weight |
| viscosity determining agents | 7 parts by weight |

pigments mixed 1:1 in plasticizer as desired.
viscosity set at 40 poise with pseudo-plasticized flow behavior.
output: 680 gr/m$^2$ Since the speed $V_2$ of support roller 3 may also be equal to 0, this means that under certain conditions, web (substratum) 4 may also be supported in the location of screen cylinder 1, by an immovable guide member.

Although the present invention has been shown and described in connection with a preferred embodiment thereof, it will be apparent to those skilled in the art that many variations and modifications may be made without departing from the invention in its broader aspects. It is therefore indented to have the appended claims cover all such variations and modifications as fall within the true spirit and scope of the invention.

What is claimed is:

1. A method of coating a permeable substratum with a viscous substance comprising:
moving the substratum at a given speed;
applying the substance to the moving substrate at an application location;
supporting the substrate against the means applying the substance with support means having a surface which contacts the substratum;
moving the support means so that the surface thereof which contacts the substratum moves at a speed which differs from the given speed of the substratum.

2. The method of claim 1 in which the substance applying step comprises pressing the substance through a screen.

3. The method of claim 2 in which the substance applying step comprises pressing the substance through a screen cylinder.

4. The method of claim 3 in which prior to the applying step, supplying the substance internal of the screen cylinder.

5. The method of claim 1 in which the substratum is moved between the means which applies the substance and the support surface.

6. The method of claim 1 in which the substratum is moved in a given direction and the surface of the support means is moved in the given direction where it contacts the substratum.

7. The method of claim 1, further comprising retaining the substratum in contact with a portion of the surface of the support means for a distance after the application step.

8. The method of either of claims 1 or 5, in which the substratum is moved such that a first surface of the substratum contacts the means which applies the substance, and a second surface of the substratum contacts the support means.

9. The method of claim 8, further comprising, after the applying of the substance to the substratum, applying a doctor to the first surface of the substratum and applying a doctor to the second surface of the substratum.

10. The method of claim 9 in which the second surface of the substratum is doctored at a point further removed from the application location than a point at which the first surface is doctored.

11. The method of claim 9 further comprising curing the substance coated on the substratum after doctoring the substratum.

12. The method of claim 11 in which the curing is performed in a gelling oven.

13. The method of claim 1 in which the speed of the surface of the support means and the speed of the substratum differ by at least substantially five percent.

14. A method of coating a permeable substratum with a viscous substance comprising:

moving the substratum at a given speed and in a given direction between the periphery of a rotatable cylindrical screen having perforations in its periphery and the periphery of a support roller, while holding the portion of the periphery of the screen and the support roller in contact with the substratum; supplying the substance internally of the cylindrical screen and pressing the substance through the perforations of the screen;

rotating the cylindrical screen so that its periphery has a speed substantially equal to the given speed of the substratum in the direction of the substratum where the screen and substratum are held in contact; and rotating the support roller so that its periphery has a speed differing from the given speed of the substratum by at least substantially five percent, and rotates in the direction of the substratum where the substratum and the support roller are in contact.

15. An apparatus for coating a permeable substratum with a viscous substance, comprising:

means for moving the substratum at a given speed;

application means for applying the substance to the substratum;

support means having a surface in contact with the substratum, for urging the substratum to contact the application means;

means for moving the surface of the support means so that the surface has a speed which differs from the speed of the substratum.

16. The apparatus of claim 15 in which the application means comprises:

a screen having a plurality of perforations; and pressing means for urging the substance through the perforation and on to the substratum.

17. The apparatus of claim 16 wherein the pressing means comprises a squeegee.

18. The apparatus of claim 16 in which the screen is in the form of a cylinder.

19. The apparatus of claim 18 in which the substance is supplied internally to the cylinder.

20. The apparatus of claim 15 in which the substratum moving means moves substratum in the given direction and the support means moving means moves the surface of the support means in the given direction where it contacts the substratum.

21. The apparatus of claim 15 in which the support means comprises a support roller.

22. The apparatus of claim 15 further comprising means for urging the substratum into contact with a portion of a surface of the support means after the substratum is coated.

23. The apparatus of claim 22 in which the means for moving the substratum moves the first area where it is coated to a second area removed from the first area, and further comprising means for providing a clearance distance between the substratum and the application means at points between the first area and the second area.

24. The apparatus of claim 22 in which the support means and the subtratum are in contact over an area defined by an area of the surface of the support means.

25. The apparatus of claim 15 further comprising first doctor means disposed above a first side of the substratum contacted by the application means for treating the first surface of the substratum; and second doctor means disposed above a second side of the substratum contacted by the support means for treating the second surface of the substratum.

26. The apparatus of claim 23 in which the doctor blades cooperate to form a flexible nip between the blades.

27. The apparatus of claim 23 in which the second doctor blade is further removed from the application means than the first doctor blade.

28. The apparatus of claim 15 in which the substratum moves between the application means and the support means.

29. An apparatus for coating a permeable substratum, with a viscous substance, comprising:

means for moving the substratum at a given speed and in a given direction, a cylindrical screen having a periphery with perforations therein, the substratum moving means moving the substratum in contact with the screen; the screen containing the substance therein;

means for pressing the substance through the perforations of the periphery of the screen;

means for rotating the screen so that the periphery of the screen travels at the given speed of the substratum and in the given direction of the substratum where the substratum contacts the screen;

a support roller having a periphery in contact with the substratum, the support roller urging the substratum to contact the screen;

means for rotating the support roller so that the periphery of the support roller has a speed which differs from the speed of the substratum by at least five percent.

* * * * *

UNITED STATES PATENT AND TRADEMARK OFFICE

CERTIFICATE OF CORRECTION

PATENT NO. : 4,363,833
DATED : December 14, 1982
INVENTOR(S) : Cornelis Blaak

It is certified that error appears in the above-identified patent and that said Letters Patent are hereby corrected as shown below:

Column 3, line 57 - Change "prior" to --further--

Signed and Sealed this

*Twenty-sixth* Day of *April 1983*

[SEAL]

*Attest:*

GERALD J. MOSSINGHOFF

*Attesting Officer*

*Commissioner of Patents and Trademarks*